US011241612B1

(12) United States Patent
Porter

(10) Patent No.: US 11,241,612 B1
(45) Date of Patent: Feb. 8, 2022

(54) MEMORY TIC TAC TOE

(71) Applicant: James Edward Porter, Norwalk, CT (US)

(72) Inventor: James Edward Porter, Norwalk, CT (US)

( * ) Notice: Subject to any disclaimer, the term of this patent is extended or adjusted under 35 U.S.C. 154(b) by 931 days.

(21) Appl. No.: 15/988,146

(22) Filed: May 24, 2018

Related U.S. Application Data

(60) Provisional application No. 62/511,005, filed on May 25, 2017.

(51) Int. Cl.
*A63F 3/00* (2006.01)

(52) U.S. Cl.
CPC ..... *A63F 3/00094* (2013.01); *A63F 3/00* (2013.01); *A63F 2003/0087* (2013.01); *A63F 2003/00832* (2013.01); *A63F 2003/00835* (2013.01); *A63F 2003/00842* (2013.01); *A63F 2003/00873* (2013.01); *A63F 2003/00876* (2013.01); *A63F 2003/00955* (2013.01)

(58) Field of Classification Search
CPC ..... A63F 3/00094; A63F 2003/0087; A63F 2003/00876; A63F 2003/00873; A63F 2003/00832; A63F 2003/00835; A63F 2003/00842; A63F 2003/00955; A63F 2003/00574; A63F 3/00
USPC ..... 273/271, 273, 287, 290, 291, 282.1
See application file for complete search history.

(56) References Cited

U.S. PATENT DOCUMENTS 3,749,401 A * 7/1973 Hayko ..... A63F 9/0204 273/389
4,335,879 A * 6/1982 Wiskur ..... A63F 3/00 273/146
4,373,732 A * 2/1983 Ogilvie ..... A63F 9/1204 273/269
4,607,847 A * 8/1986 Chung ..... A63F 3/00094 273/264
5,318,307 A * 6/1994 Bouchard ..... A63B 67/06 273/348.4
2018/0147480 A1* 5/2018 Krause ..... A63F 1/04

* cited by examiner

*Primary Examiner* — Benjamin Layno
(74) *Attorney, Agent, or Firm* — Adam R. Stephenson, Ltd.

(57) ABSTRACT

A more challenging tic-tac-toe game is described. This game makes use of an apparatus comprising a grid of openings configured to receive multi-sided playing pieces that each have a symbol on one side that once the playing pieces are inserted into the grid openings with the symbol not visible to the players, each player must memorize their moves to successfully place symbol playing pieces adjacently in a row or obtain tic-tac-toe. This game can be played in several different modes, including electronic versions, with varying complexity. In this game, each move, of each player, is hidden from view once a move has been made and when a player believes they have formed tic-tac-toe, the game apparatus reveals the moves and whether a player has successfully formed tic-tac-toe or not. The methods of play combined with a game assembly that can shield moves from each player but also reveal past moves at the end of play or at other appropriate times provides a challenging game that utilizes a combination of strategic thinking and memory.

13 Claims, 9 Drawing Sheets

MEMORY TIC TAC TOE

FIELD

The present invention generally relates to tic-tac-toe games and more particularly to games involving memory and strategy, including game assembly, computer program products and methods of play relating thereto.

BACKGROUND OF THE INVENTION

Traditional tic-tac-toe is easy to learn and simple to play. Played on a grid with 9 squares (3×3), two opposing players utilize two different symbols, typically an "X" and an "0", and alternate turns placing or writing their respective letters in selected squares within the square grid, e.g., by filling in blanks on the grid with their chosen letter. The goal of this traditional version of the game is to obtain three X's or three O's in a row either horizontally, vertically or diagonally. This is a tic-tac-toe. The player who does this first is declared the winner. A secondary objective in playing traditional tic-tac-toe is to block the opposing player from successfully achieving a winning three square combination; however, if both players successfully block each other, the game ends in a draw. This secondary objective is often effectively implemented by both players, leading to a high percentage of games that end in a draw.

Most children learn how to play the game of tic-tac-toe at an early age and most adults know the game. Despite being very popular, the game is almost too easy and often ends in a draw with neither player winning. Most players lose interest after just a few games and rarely play it for extended periods or after childhood.

There are various versions of the traditional tic-tac-toe game designed to make the game more challenging. Despite the many versions of tic-tac-toe, there is still a need to make the game more challenging and attractive to play.

SUMMARY

Embodiments of the present invention include a game assembly for playing tic-tac-toe that comprises playing pieces and an apparatus configured to hide each move from view of the players during play and then reveal the moves at or near the end of play or when a player believes he or she has successfully placed three of his or her symbol playing pieces in a consecutive row, horizontally, vertically or diagonally. A move is the placement of a symbol playing piece in a playing area or opening disposed within the game apparatus, e.g., a three-dimensional grid of three rows and three columns, such grid comprised within the apparatus. Each player attempts to get tic-tac-toe, or successful placement i.e., place three playing pieces in a corresponding number of adjacent playing areas or openings that are aligned horizontally, vertically or diagonally within the three-dimensional grid. Players also attempt to otherwise block their opposing player from obtaining tic-tac-toe.

The games of the present invention are more challenging to play than traditional tic-tac-toe games as they call for players to memorize their own and their opponents moves during play and to also think strategically. Another benefit is that the tic-tac-toe game, played in accordance with methods described herein, can lead to a lower number of games that end in a draw, compared to traditional tic-tac-toe. Embodiments of the invention further provide for a game that appeals to a broader range of players, not just children, but elder persons wishing to exercise memory skills and combine that with strategic thinking.

The games of the present invention may be embodied as a game assembly comprising an apparatus and a plurality of playing pieces. All playing pieces are multisided pieces and in some embodiments they are cube in shape. Different players use different sets of playing pieces which may be distinguished by color, symbols or both.

The number of playing pieces varies depending on the game version. In one version, referred to herein as a simple version, there are at least 10 multi-sided playing pieces with each piece having a symbol disposed on one side, with the remaining sides of each playing piece blank. These are referred herein as "symbol playing pieces". Half the symbol playing pieces have one symbol disposed on one side and the other half of the symbol playing pieces have a different symbol. Symbols may be any two symbols and preferably two letters, more preferably an "X" and an "O".

Game apparatus comprises a housing, a grid disposed within the housing, said grid resting on a base constructed to display the symbol on each playing piece when the playing pieces are inserted into the grid with the symbol side facing down against the base. The grid comprises three rows and three columns to provide 9 openings. The openings are configured to receive the playing pieces. In some embodiments, the openings are configured or constructed to receive and secure playing pieces such that the playing pieces inserted into the openings remain within the openings when the apparatus is inverted or turned upside down, with the base on top. The apparatus can be designed with a base that is transparent or contains apertures, such that when the apparatus is flipped over or tipped, the base reveals which player has placed which symbol playing piece where and which player has obtained tic-tac-toe and won.

There are multiple methods of playing the game. To play a game, in accordance with a simple version of the invention, symbol playing pieces are divided among the players with one player having half the pieces depicting one symbol and the other player having the other half of the pieces depicting the other symbol. Each player then alternates placing one of their symbol playing pieces into the grid with the symbol side positioned down against the base and hidden from view. As the game is played, players need to remember prior moves to win. The game may be played until a player announces that he or she believes they have formed tic-tac-toe, either correctly or incorrectly, as determined by observing the base of the apparatus. For example, the determination may be made by flipping the apparatus over or lifting the apparatus up or tipping it so that players can observe the base to see if a has player formed a tic-tac-toe. If the player announcing tic-tac-toe is incorrect, the other player wins. To win, a player must obtain tic-tac-toe, recognize it and correctly announce it. In some embodiments, methods of playing the game can involve a player announcing "flip-tac-toe" or "tip-tac-toe" instead of tic-tac-toe" when a player believes they have successfully placed three of their symbol playing pieces in a row. For purposes herein, reference to a selection of three symbol playing pieces in a row refers to the placement of such pieces in three adjacent playing areas or grid openings that are adjacent and aligned either horizontally, vertically or diagonally.

In another version of the game, referred to herein as a longer version, a game assembly comprises an apparatus and playing pieces that include at least 10 symbol playing pieces as described above and additionally at least 9 multi-sided playing pieces that are each blank on all sides, also called "blank playing pieces" for purposes herein. To play a game, in accordance with the longer version, an apparatus is used which comprises a housing, a 3 column 3 row grid disposed within the housing or the interior cavity of the housing, said grid resting on a base constructed to display the symbol on each symbol playing piece when the playing pieces are inserted into the grid with the symbol side down against the base, except that before the game begins, blank playing pieces are first inserted into all openings within the grid. To make a move, each player must remove a blank playing piece from the grid and replace the blank playing piece with one of his or her symbol playing pieces by positioning the symbol playing piece in the opening with the symbol facing down against the base. Each player takes turns, removing a blank playing piece to create an opening and inserting a symbol playing piece into the opening. If a player attempts to remove a blank playing piece and instead mistakenly removes any symbol playing piece, that player loses. A goal for each player is to remember where all symbol playing pieces have been inserted and blank playing pieces remain and avoid mistakenly removing any symbol playing pieces. An additional goal is for each player to form tic-tac-toe with their symbol playing pieces. The longer version of the game is played until a player attempts to remove a blank playing piece from the grid and instead incorrectly removes any symbol playing piece; or a player announces a successful placement of three symbol playing pieces in a row, or tic-tac-toe, as determined by observing the base; or a player incorrectly announces placement of three symbol playing pieces in a row, as determined by observing the base; or all symbol playing pieces are inserted into all grid openings and no tic-tac-toe is announced (a draw).

In this longer version of the game, the step of alternatingly removing extra blank playing pieces disposed in the grid openings before each play, provides greater challenge and requires more concentration. When all openings on the grid contain (at the start) blank blocks which look identical to the (upside down) lettered bocks and must be first removed on each play before a symbol playing piece is positioned in each opening, the players not only must memorize which moves have already been made, but which spaces are still available for their next moves. This makes the game significantly harder to play.

According to methods of play described herein, a game between players not only may end when one player forms a tic-tac-toe but may also end when a player fails to properly remember prior moves, impacting his or her success in the game. For example, a player may fail to accurately remember prior moves of his own or another player, and then mistakenly announce that he or she has formed tic-tac-toe when they have not. In another example, which can occur in playing the longer version of the game where blank playing pieces are initially removed in alternating fashion prior to inserting a playing piece into the grid, a player may fail to accurately remember the location of remaining blank playing pieces and incorrectly remove a symbol playing piece from the game apparatus rather than a blank playing piece.

Methods of playing a tic-tac-toe game using game apparatus and playing pieces contemplated herein are further described. Some embodiments include a method of playing a game comprising a) dividing symbol playing pieces between two players so that one player has at least 5 pieces each having one symbol on one side and another player has an equal number of playing pieces each having a different symbol on one side; b) playing the game by alternatingly having each player insert a playing piece into an opening within the a game apparatus grid, said playing piece positioned so that the symbol faces down against the base of the game apparatus; and c) playing the game until one of the following occurs: i) a player correctly announces a successful placement of three symbol playing pieces in a row, as determined by observing the base ii) a player incorrectly announces placement of three symbol playing pieces in a row, as determined by observing the base, iii) symbol playing pieces are inserted into all openings in the grid.

In other embodiments a methods of playing a game comprise: a) inserting blank playing pieces into all openings in the grid; b) at any time prior to playing the game, dividing the symbol playing pieces between two players so that one player has at least 5 pieces each having one symbol and the other player has an equal number of playing pieces each having a different symbol; c) playing the game by alternatingly having each player remove a blank playing piece from the grid and replace said blank playing piece with one of his or her symbol playing pieces by positioning said symbol playing piece so that the symbol faces down against the base; d) playing the game until one of the following occurs: i) a player attempts to remove a blank piece from the grid and instead incorrectly removes any symbol playing piece; ii) a player correctly announces a successful placement of three symbol playing pieces in a row, as determined by observing the base ii) a player incorrectly announces placement of three symbol playing pieces in a row, as determined by observing the base, iii) symbol playing pieces are inserted into all openings in the grid. Optionally, in the event that symbol playing pieces are inserted into all openings in the grid and no player correctly announces placement of their symbol playing pieces in a row or tic-tac-toe, rather than having the game end in a draw at that point, the players may continue to play by taking turns removing their symbol playing pieces from the apparatus grid. A player who mistakenly removes the other player's symbol playing pieces loses. This can further reduce the percentage of games that end in a draw while providing even greater challenge and enjoyment. All versions of the game described may alternatively be embodied as a computer program product, as contemplated herein and using knowledge in the art.

Of course, the present invention is not limited to the features and advantages described herein. Indeed, those skilled in the art will recognize additional features and advantages upon reading the following detailed description, and upon viewing the accompanying drawings.

DETAILED DESCRIPTION

Figure 1:
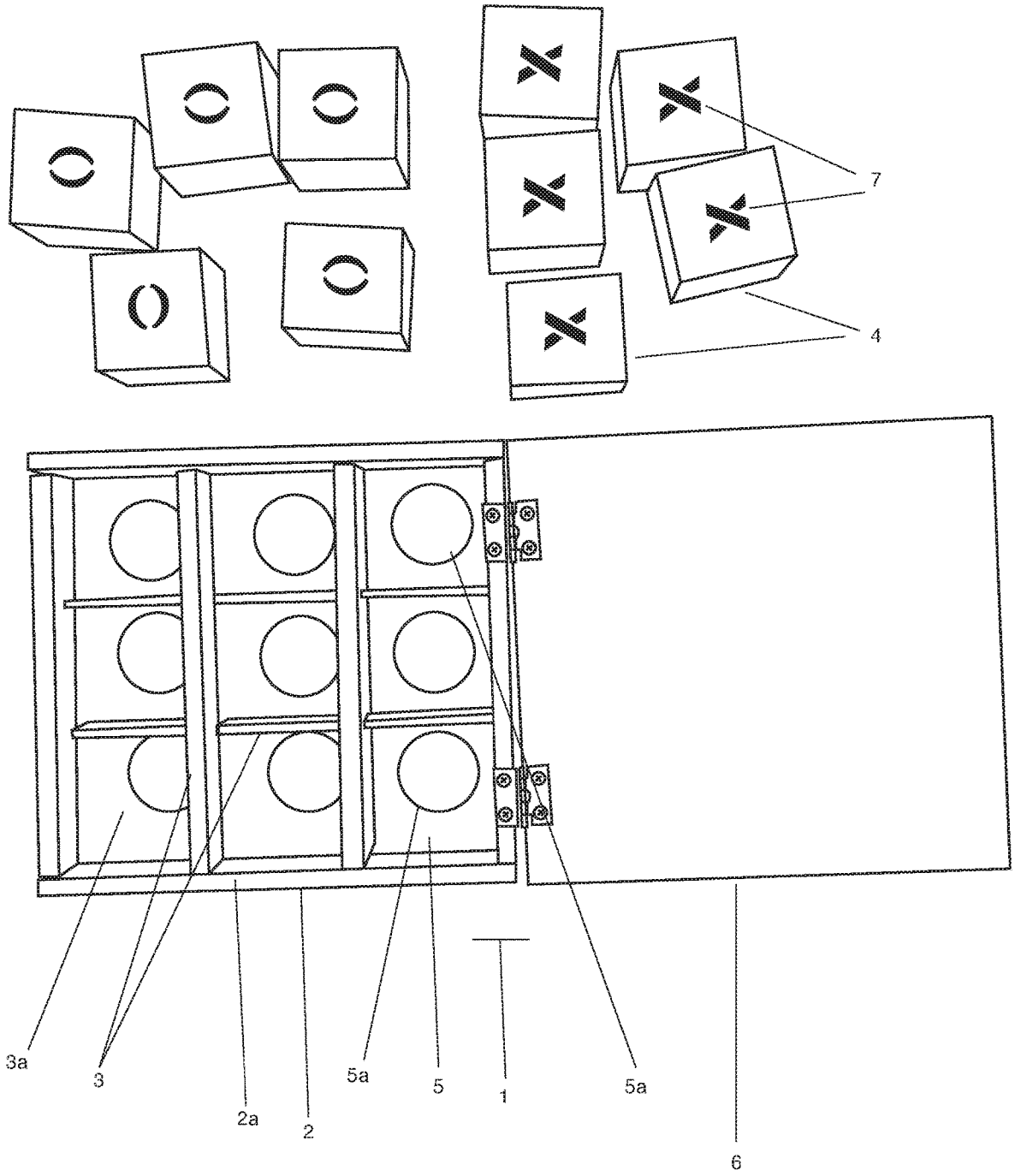
FIG. 1 shows a top view of a game assembly including game apparatus housing, grid, base and lid (open) and symbol playing pieces according to an embodiment of the invention.

FIG. 1 illustrates a game apparatus 1 according to one or more embodiments which comprises a housing 2 that defines an interior cavity 2*a*. Disposed within the interior cavity is a grid 3 that defines multiple rows and columns to form a matrix of openings 3*a*, here 3 rows and 3 columns to form a matrix of 9 openings. Openings or grid openings 3*a* may also be referred to as playing areas herein. The openings 3*a* are configured to receive multi-sided playing pieces 4.

The height of grid walls may be equal to or less than the height of the housing. In some embodiments where the height of the grid walls are less than the height of the housing, the grid walls are lower than the height of the housing so that playing pieces may be grasped by players and easily removed from the grid; for example, the grid height may be ¼ inch lower than the housing or ¼ inch lower. The number of grid walls can vary. In some embodiments, there are more grid walls in one direction than the other direction. The width of all grid walls can be equal in size or vary and may depend on the number of grid walls within the housing cavity. In some embodiments, the width of all grid walls are equal and the width is ¼ inch. In other embodiments, the grid wall width is ⅛ inch. In some embodiments the grid walls are variable in width. Facilitating easy insertion and removal of playing pieces in and out of the grid is considered in selection of number of grid walls and width. In some embodiments, two to four grid walls have a slightly larger width than the other grid walls, for example ¼ inch and ⅛ inch. The number of grid walls may also depend on the number of grid openings, the playing piece sizes relative to the grid opening and the fastening material. The grid is designed to enable players to easily remove playing pieces from the grid openings. For example, an apparatus with 9 grid openings may include two horizontal grid walls and two vertical grid walls to provide 9 playing areas but in other embodiments, additional grid walls may be included along two or more interior sides of the housing to provide room for players to easily grab and remove playing pieces from the grid. In some embodiments, 9 playing areas are formed by 4 vertical grid walls and 2 horizontal grid walls, see for example, FIG. 4, described below. The apparatus need not be exactly square but can be as long as grid openings are substantially identical in size and shape. In some embodiments one length of the apparatus housing in longer than the other, in some embodiments $\frac{1}{4}^{th}$ inch longer.

The grid rests on a base. What is meant by this is that the grid is above the base. The grid may or may not connect with the base. The base is flat and may be connected to the grid or to the housing or to both. The base connects to the housing at the bottom side of the housing. For clarity and purposes herein, the terms "top", "bottom" and "above" refer to orientation of the game apparatus when the game is being played and not when the game is turned upside down to determine a winner. The base is constructed and/or configured to display the symbols on symbol playing pieces when the symbol playing pieces are inserted into grid openings with the symbol side positioned down against the base. In certain embodiments, the base is comprised of transparent material that displays symbols on symbol playing pieces when such playing pieces have been inserted into grid openings with the symbol side positioned down against the base.

In other embodiments, for example in FIG. 1, the game apparatus has a base 5 comprised of holes or aperture features 5*a* positioned at the center of each grid opening. FIG. 1 shows 9 gird openings and the base can be seen which comprises 9 apertures centered in each grid opening. In embodiments where the base contains apertures, such apertures are sized with a diameter such that symbols on symbol playing pieces are displayed for viewing when the symbol playing pieces have been inserted into grid openings with the symbol side down against the base. Regarding such display, when a player believes they formed a tic-tac-toe, the base may be observed in various ways which may include flipping or inverting the game apparatus up-side down or by lifting it up or tipping the game apparatus to observe the base. In FIG. 1, the game apparatus comprises a lid 6 attached at the top of the housing, opposite the base 5. The lid is open. When the lid is closed, playing pieces that have been inserted into grid openings are secured therein so that symbols on the inserted playing pieces may be observed from the base, to determine whether a tic-tac-toe has been formed.

Figure 2:
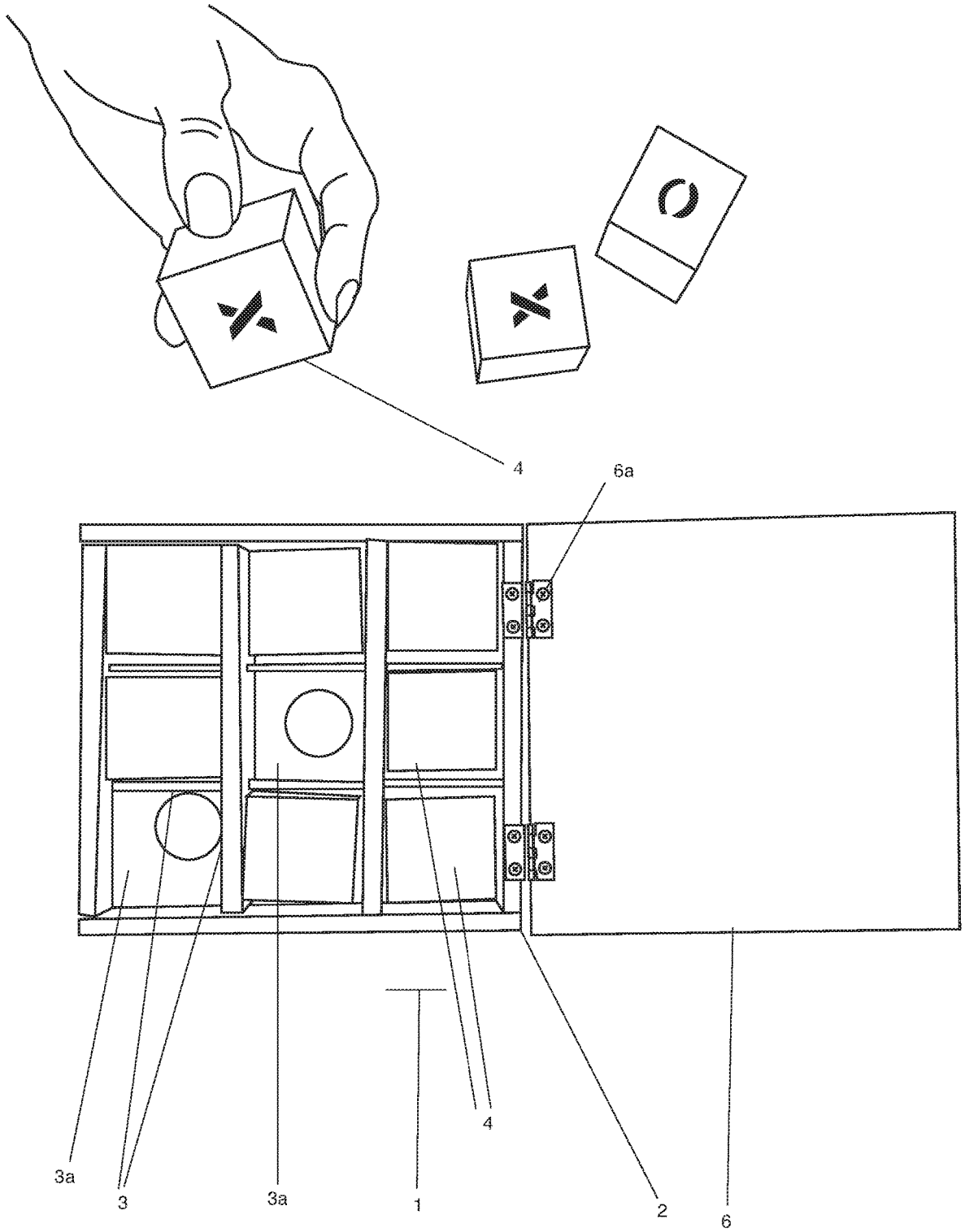
FIG. 2 shows a top view of game apparatus including housing, grid, base and lid (open); the apparatus grid provides for grid openings or playing areas and 7 symbol playing pieces sit within the grid openings having been inserted therein with the symbol facing down, not in view. An additional symbol playing piece is shown in a player's hand as it is about to be inserted into the grid opening, with the symbol facing down against the base.

FIG. 2 illustrates a game assembly that includes an apparatus comprising a housing 2 that defines an interior cavity; a grid 3 is disposed within the interior cavity and a lid 6 (open) is attached with a hinge 6*a* to the housing along one side at the top of the housing; the apparatus grid 3 provides for grid openings 3*a* or playing areas. In this embodiment, the height of the grid walls are less than the housing height and the playing pieces are sized so that they can be removed by players from the grid. In FIG. 2 symbol playing pieces 4 sit within the grid openings having been inserted therein with the symbol facing down, not in view, and an additional symbol playing piece 4 is shown in a player's hand as it is about to be inserted into a grid opening with the symbol facing down against the base.

Figure 3:
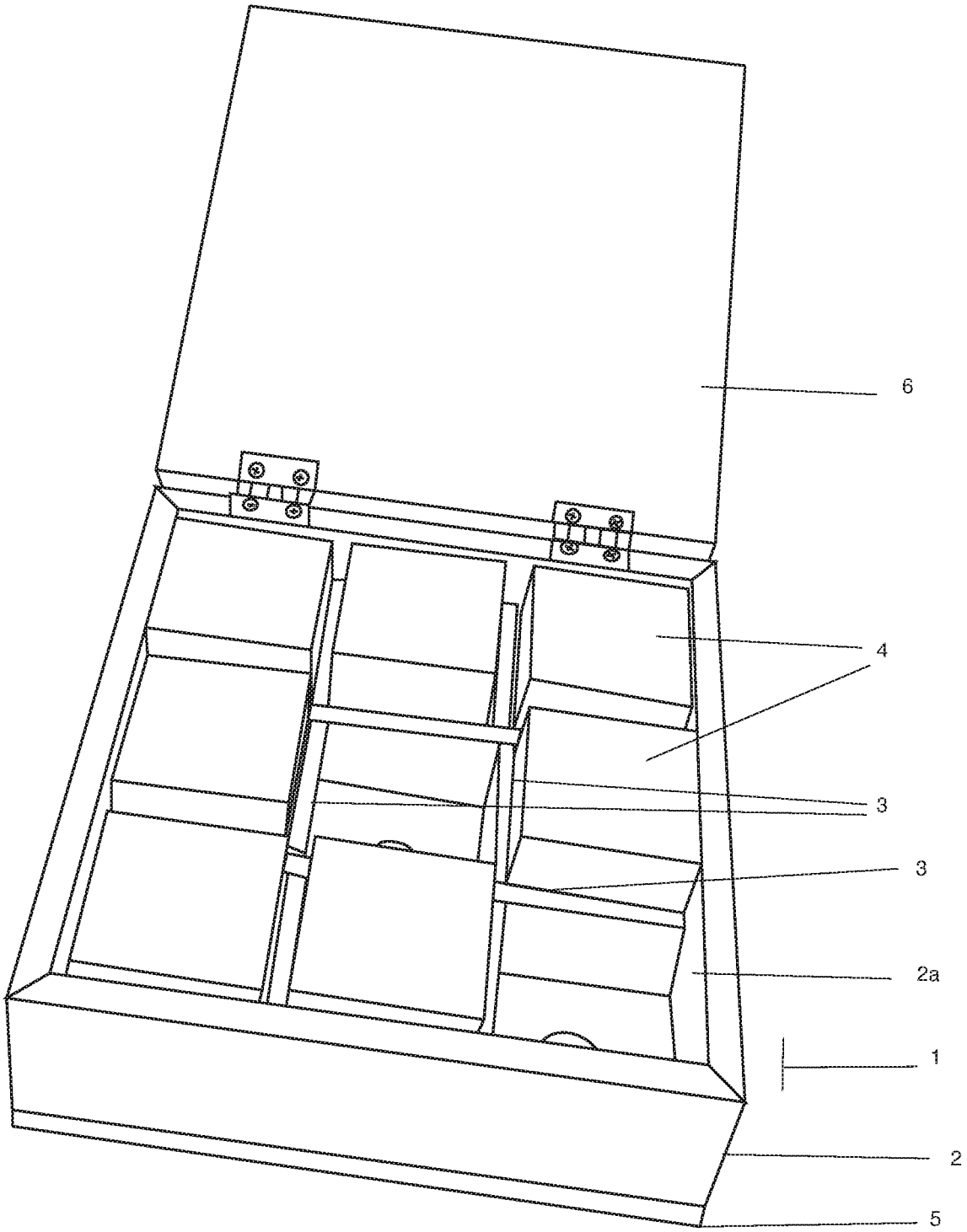
FIG. 3 shows a side view of a game apparatus in an embodiment of the invention. A lid (open) is connected to the top of the housing and a base is connected to the housing bottom. Playing pieces are inserted into several grid openings.
Figure 4:
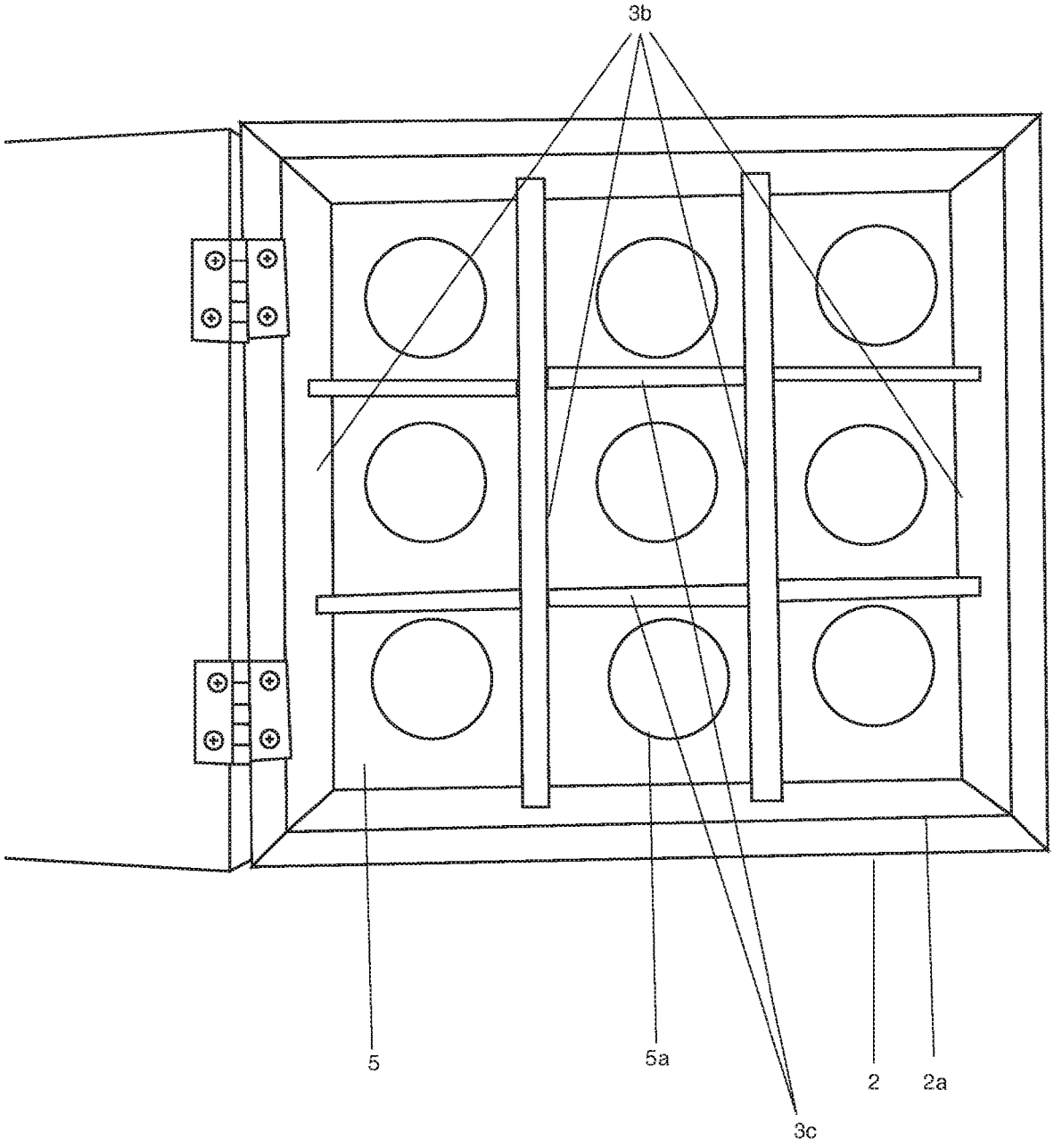
FIG. 4 shows a close-up view of a game apparatus interior defined by the housing where grid walls are disposed within the interior creating grid openings or playing areas. The grid walls rest on a base comprising apertures positioned within each playing area.

Construction of the game apparatus in accordance with the present invention enables players to view past moves from the base. FIG. 3 depicts a side view of a game apparatus 1 containing several playing pieces 4 positioned within the grid 3. In this embodiment, the height of all grid walls are less than the height of the housing 2. The base 5 connects to the bottom side of the housing 2. All playing pieces are cube shaped and substantially equal in size. FIG. 4 shows an embodiment of the invention in which the apparatus housing interior 2*a* contains a grid 3 made up of four vertical grid walls 3*b* and two horizontal grid walls 3*c*. The 2 additional grid walls along the inside of the housing cavity create space to facilitate easy removal of playing pieces from the playing areas in the grid.

Figure 5:
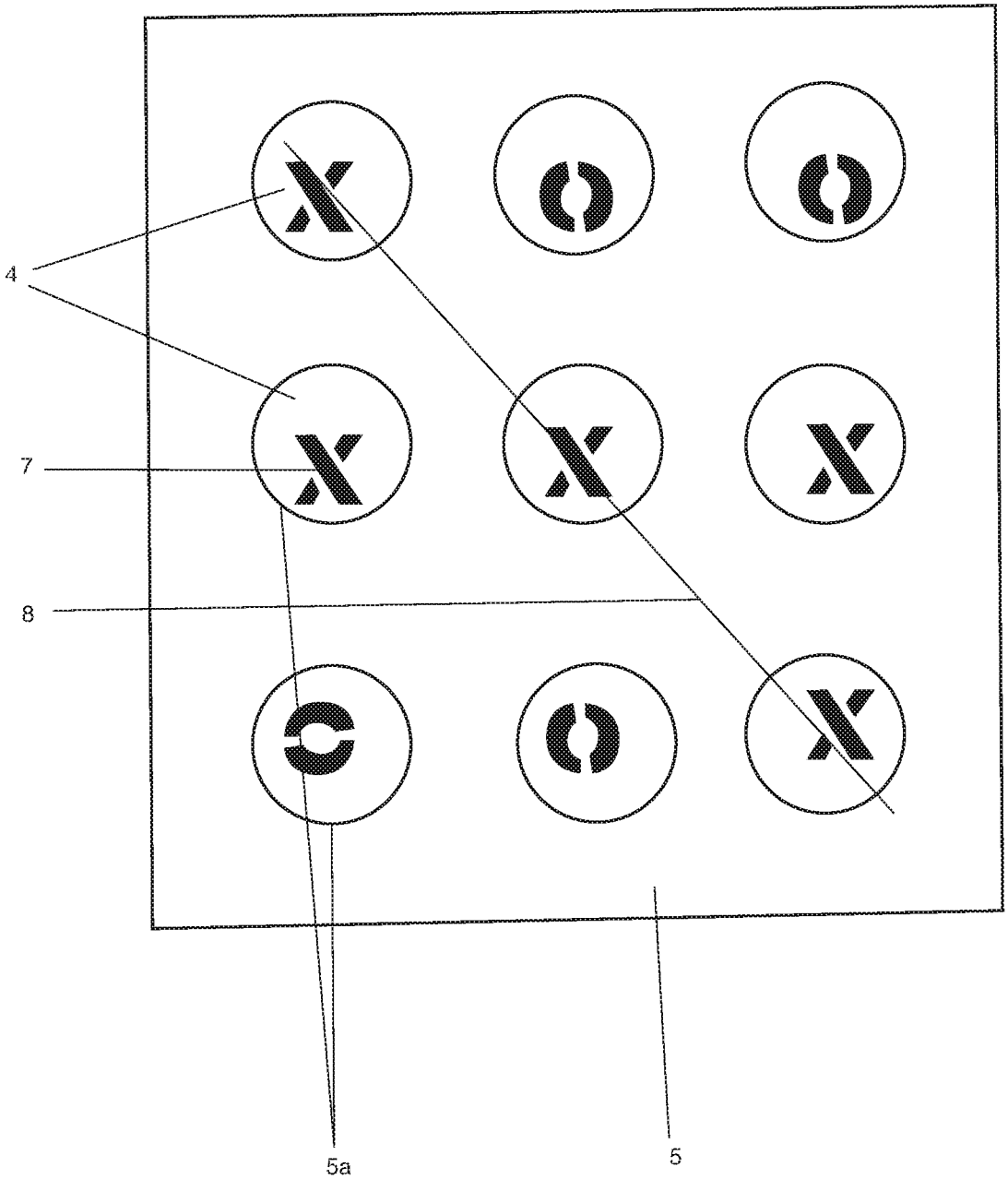
FIG. 5 shows a game apparatus inverted, lid closed (not shown) with the base in view; apertures in the base reveal symbols on symbol playing pieces previously inserted into the grid openings and removably secured within the grid openings; a diagonal tic-tac-toe for the player with the "X" symbol playing pieces is displayed.

FIG. 5 shows a game apparatus that has been inverted, with the base in view, after the lid is closed (not shown). The lid removably secures symbol playing pieces 4 that have been inserted into the grid during play. Apertures 5*a* in the base 5 reveal symbols 7 on symbol playing pieces 4 previously inserted into the grid openings with the symbol side positioned against the base; a diagonal tic-tac-toe with "X" symbol playing pieces is displayed. A second horizontal tic-tac-toe is also displayed. Note that more than one tic-tac-toe may be created during play. A player needs to announce the tic-tac-toe to win. A tic-tac-toe that is not announced upon completion is not a successful placement of three playing pieces in a row and play continues.

The base is designed to display symbols from playing pieces inserted into the grid in accordance with the game. In embodiments where the game apparatus is constructed so that the openings receive and secure playing pieces, once inserted into the apparatus grid, players can more easily determine when a player has won or formed tic-tac-toe or not by easily flipping or inverting the game apparatus and viewing the base, making the game more enjoyable. Various materials may be used to construct the playing pieces, the game assembly and various parts thereof including the grid, housing and base. Any suitable material may be used, for example, wood, plastic, composite and acrylic glass. The base may be constructed using materials that are the same or different than the housing, grid and lid. In some embodiments, material used to construct components of the apparatus are different. For example, materials used to construct the base may be different than material used to construct any portion of the apparatus, or all components thereof. In certain embodiments, the grid and housing are made of wood and the base is made of transparent plastic, glass or acrylic glass. In some embodiments, the grid, housing and base are all made of wood and playing pieces are made of a different material. In some embodiments, all components of the game assembly including the apparatus and playing pieces are made of the same material. For example, in some embodiments, wood material is used to make all components of the game assembly including the game apparatus and playing pieces. In some embodiments, plastic material is used to make all components of the game assembly. Transparent materials may be used to construct the base and/or the lid, such materials may include, for example, acrylic glass, clear plastic and glass.

In some embodiments, apertures are included in the base, positioned within the center of each opening or playing area. The size of the apertures should be large enough to display the symbols on the symbol playing pieces but not so large that the playing pieces pass through the grid and base, when positioned in the grid. The width of the base may be any appropriate width to align with the housing; in some embodiments, particularly when the base contains apertures to view symbol playing pieces, the apertures are of a size to optimize visibility of the symbols on the symbol playing pieces displayed through the base.

In embodiments of the invention, the game apparatus, is constructed to receive and removably secure playing pieces such that the playing pieces remain within the grid openings when the apparatus is turned upside down but are not permanently secured so that playing pieces may be removed from the grid openings at the end of play or other times as desired. Fastening material may be used in construction of the apparatus housing, grid or base to enable the apparatus to removably secure playing pieces in the grid openings. Any fastening material that secures but does not permanently secure a playing piece within the apparatus housing may be used to secure playing pieces within the grid openings after they are placed there by a player. In some embodiments fastening materials include but are not limited to magnets, mechanical material and Velcro branded products. For example, magnets may be positioned within the interior cavity defined by the housing, for example on the sides of the grid openings or the base in a position that can removably secure playing pieces within the grid without obstructing the view of playing piece symbols from the base once a playing piece is inserted into the grid opening. Other material known in the art that removably secures playing pieces in the openings may be used and incorporated in or added to any portion of the apparatus. In embodiments where fastening material is added to the interior of the cavity on the base, and the base contains apertures, the fastening material is positioned on or within the base surrounding the apertures. In some embodiments, a fastening material comprises a cover or lid, herein a "lid", connected to the housing and positioned on the top side of the housing to hold the playing pieces in the grid openings when the apparatus is inverted, see for example FIG. 1 (lid open) and FIG. 5 (lid closed and not shown). In such embodiments, the base is located on the bottom side of the housing and may be viewed when the apparatus is inverted upside down. The lid may be permanently or integrally connected to the housing on one side, for example, with a hinge. A latch may optionally be attached to the lid which can be used to close the apparatus against the housing and secure playing pieces within for storage or the like when the game is not being played. In some embodiments, the lid is not permanently connected to the housing but instead is designed to securely fit onto the top of the housing. The lid may be constructed out of any material such, for example, wood, plastic, composite, acrylic glass or the like. The lid may be constructed from material that is the same or different than the game apparatus or components therein. In some embodiments, the lid and the entire apparatus including the base is wood. In some embodiments, the lid and base are clear material, acrylic glass or plastic, and the apparatus housing and grid are wood.

Playing pieces include at least 10 symbol playing pieces and, in embodiments where a longer version of the game is played, additionally at least 8 blank playing pieces are included along with the symbol playing pieces. All playing pieces are multi-sided and of a shape and size designed to fit into the openings in the grid of the apparatus. All playing pieces, including symbol and blank pieces, are identical in size and shape. In some embodiments playing pieces are cube shaped and the openings in the apparatus grid openings are square. In some embodiments the playing pieces are square cuboid shapes (½ the height of a cube) that allow blank blocks to be stacked on top of symbol blocks for easy storage of both blank blocks and lettered blocks. Grid openings are configured or constructed to receive playing pieces. Configuration may include selection of suitable size and shape. In some embodiments, the game apparatus is constructed to receive and secure playing pieces such that playing pieces remain within the openings when the apparatus is inverted upside down. Construction may also include selection of material for any portion of the apparatus grid, housing, interior cavity or base.

With respect to symbol playing pieces, two sets of playing pieces distinguished by symbol and optionally color or other means are used. Symbols may be any two symbols and should appear on one side of each playing piece, with all other sides of each multi-sided playing piece being blank. Symbols should be disposed in the center of the one side on each multi-sided symbol playing piece. In some embodiments, symbols are letters. In some embodiments, symbols are X's and O's. All symbol playing pieces in a game assembly should be identical in size and shape. Once placed by a player into the grid with the symbol side facing down against the base, playing pieces should appear identical to each other (i.e., blank) within the apparatus grid, when viewed by players during the game, so there is no way for either player to track their moves other than by memorizing where each block has been placed.

In some embodiments block or cube shaped symbol playing pieces fit in a board like grid with square openings. Said playing pieces may be held in place within the grid by the construction of the apparatus, housing or three dimensional grid; fastening material may be used in the construction of the apparatus. In some embodiments, fastening material is selected from a lid, magnets or Velcro brand products.

One embodiment of a simple version of the game comprises 10 symbol playing pieces shaped as blocks, with 5 blocks each having an X inscribed or otherwise depicted on one side and 5 additional blocks each having an O on one side. Each player selects a set of 5 blocks, either all X or all 0. The two players decide which player will go first and alternate who goes first on each successive time they play the game. The player who goes first places his or her symbol playing piece into a grid opening in the (3×3) grid with the letter facing down against the base. The second player follows placing his or her playing piece into a vacant opening in the grid. Each player takes turns placing their respective playing pieces into the grid until all the openings are filled or one player believes he or she has formed tic-tac-toe, which may be correct or incorrect.

The game can end when one player announces that he or she has positioned their symbol playing pieces adjacently three in a row (either horizontally, vertically or diagonally). At that point the player lifts up or inverts the game apparatus to observe the base to see if his or her assumption is correct. In embodiments that utilize a lid, the lid is closed to secure playing pieces within the grid beforehand. Once the base is observed, if the player is correct, that player wins. If wrong, the other player wins. The game ends in a draw when all the spaces are filled with symbol playing pieces, and/or no one announces placement of three playing pieces in a row. To win, a player must form tic-tac-toe and also announce it or the like in accordance with some embodiments.

Optionally, players may end the game a different way when they have come to a draw. In the event that all the openings are filled with symbol playing pieces, and neither player has declared himself a winner, the players may instead continue to play and each player then takes turns pulling his or her symbol playing pieces (X or Y) out of the grid one by one. The first person to choose an incorrect playing piece, i.e., the other player's symbol playing piece, loses. This extended version of the game further reduces the probability of a draw; this version ends in a draw only if each player removes all their symbol playing pieces from the grid openings correctly. This extended method of play may be applied to the simple or longer version of the game to provide greater challenge.

In any of the embodiments of the game, score may be kept for multiple games, with a point for each win. Optionally, game assembly may include additional game pieces for keeping score, which pieces may be separate from the game apparatus or connected to or integral with the game apparatus. In one embodiment, a separate scoreboard is included and pegs on a scoreboard board may be moved forward each time a player wins a game. First player to win ten or any designated number of games wins the match.

Figure 6:
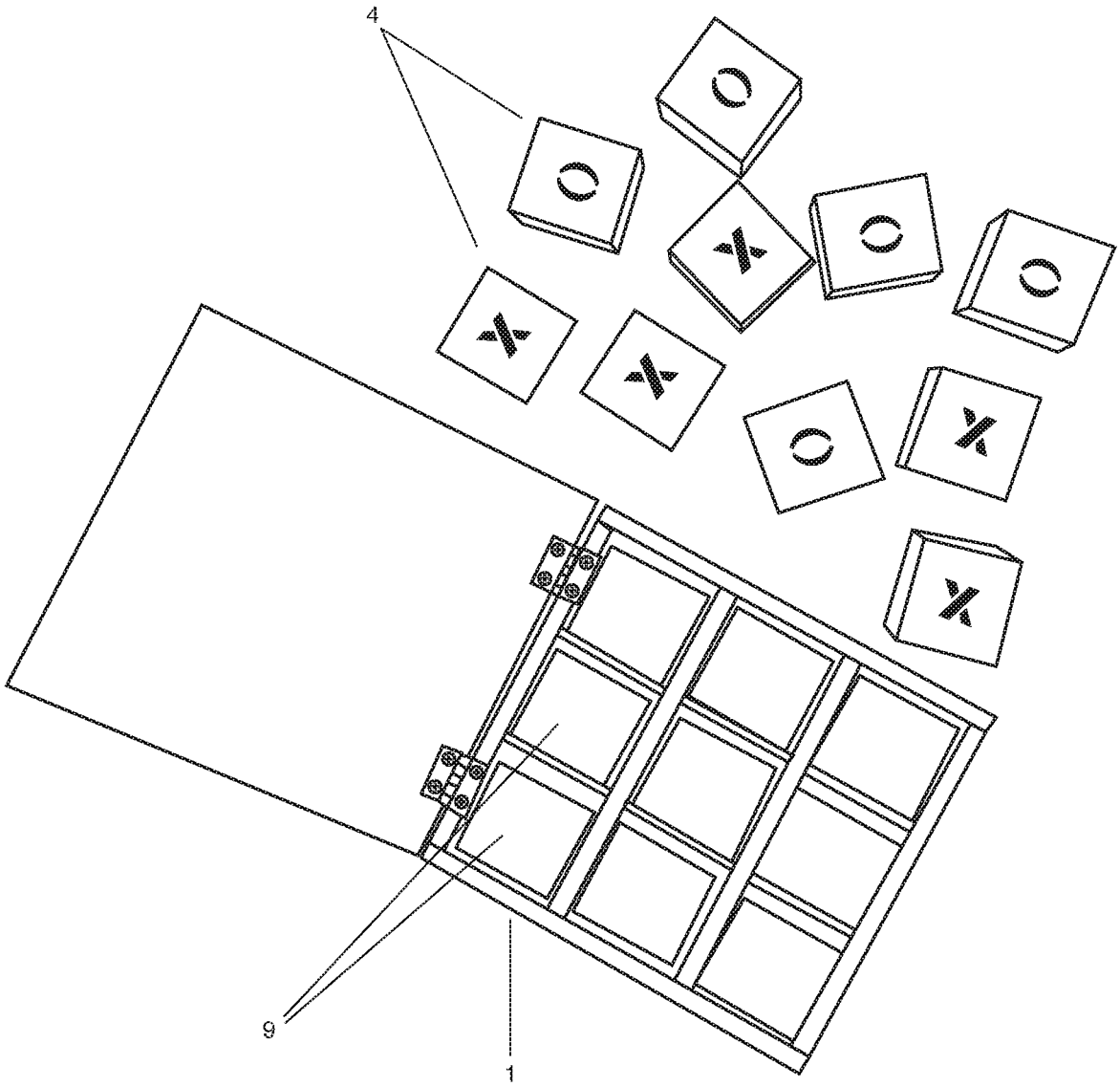
FIG. 6 shows a top view of a game apparatus containing bank playing pieces in all grid openings; Symbol playing pieces sit outside of the apparatus in the background, ready to be inserted into the grid openings when each player makes a move by selecting a playing area and removing a blank playing piece from the selected playing area or grid opening to then insert a symbol playing piece into the grid opening with the symbol directed down towards the base.
Figure 7:
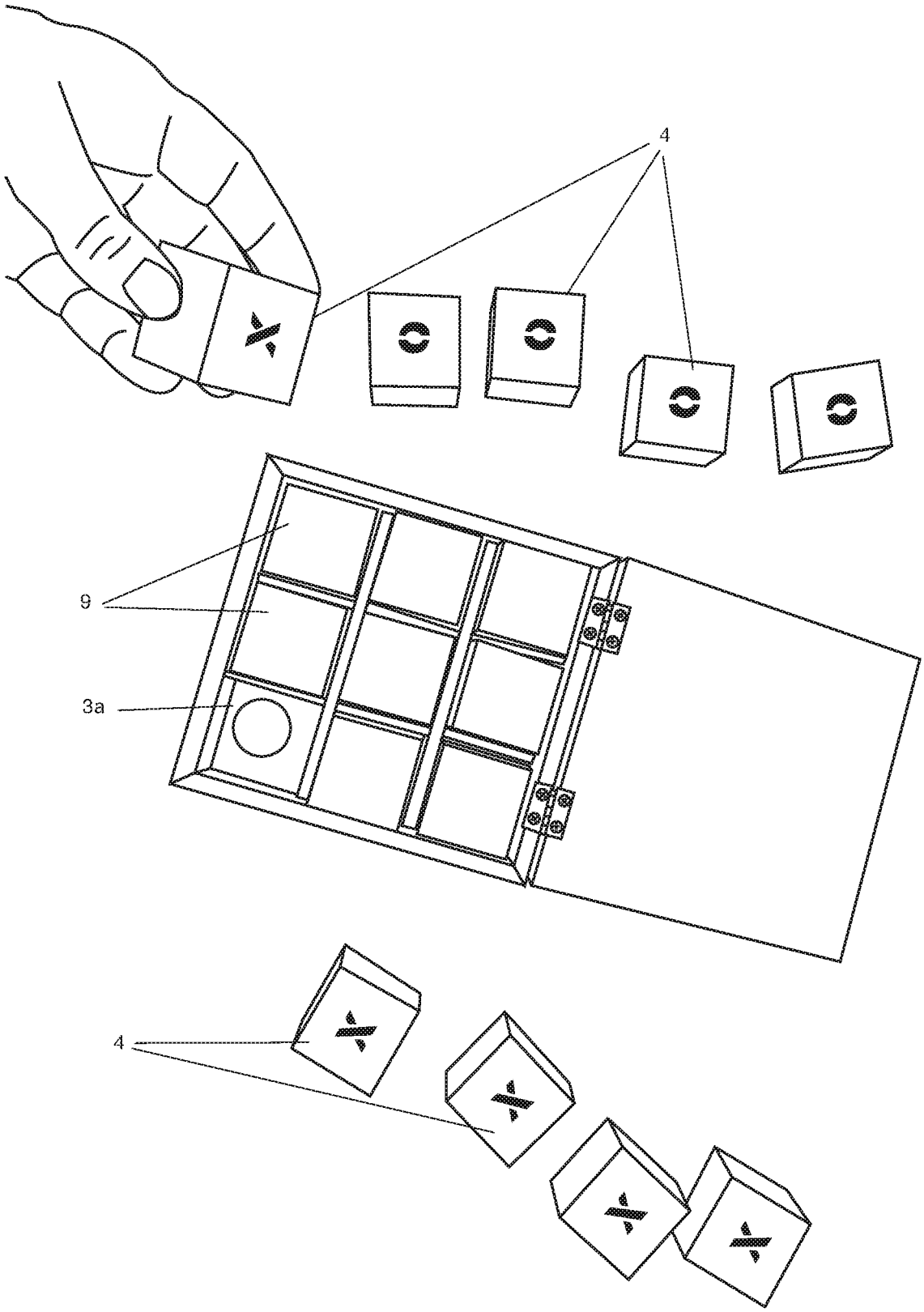
FIG. 7 shows a top view of a game apparatus containing blank playing pieces in 8 of the 9 grid opening. The player making the first move, by having selected the first open playing area, is shown inserting his or her symbol playing piece into the selected open playing area as shown. Symbol playing pieces sit outside the apparatus on the side ready to be inserted into the playing areas or grid openings alternatingly by each player after each player selects a playing area and attempts to remove a blank playing piece therefrom.
Figure 8:
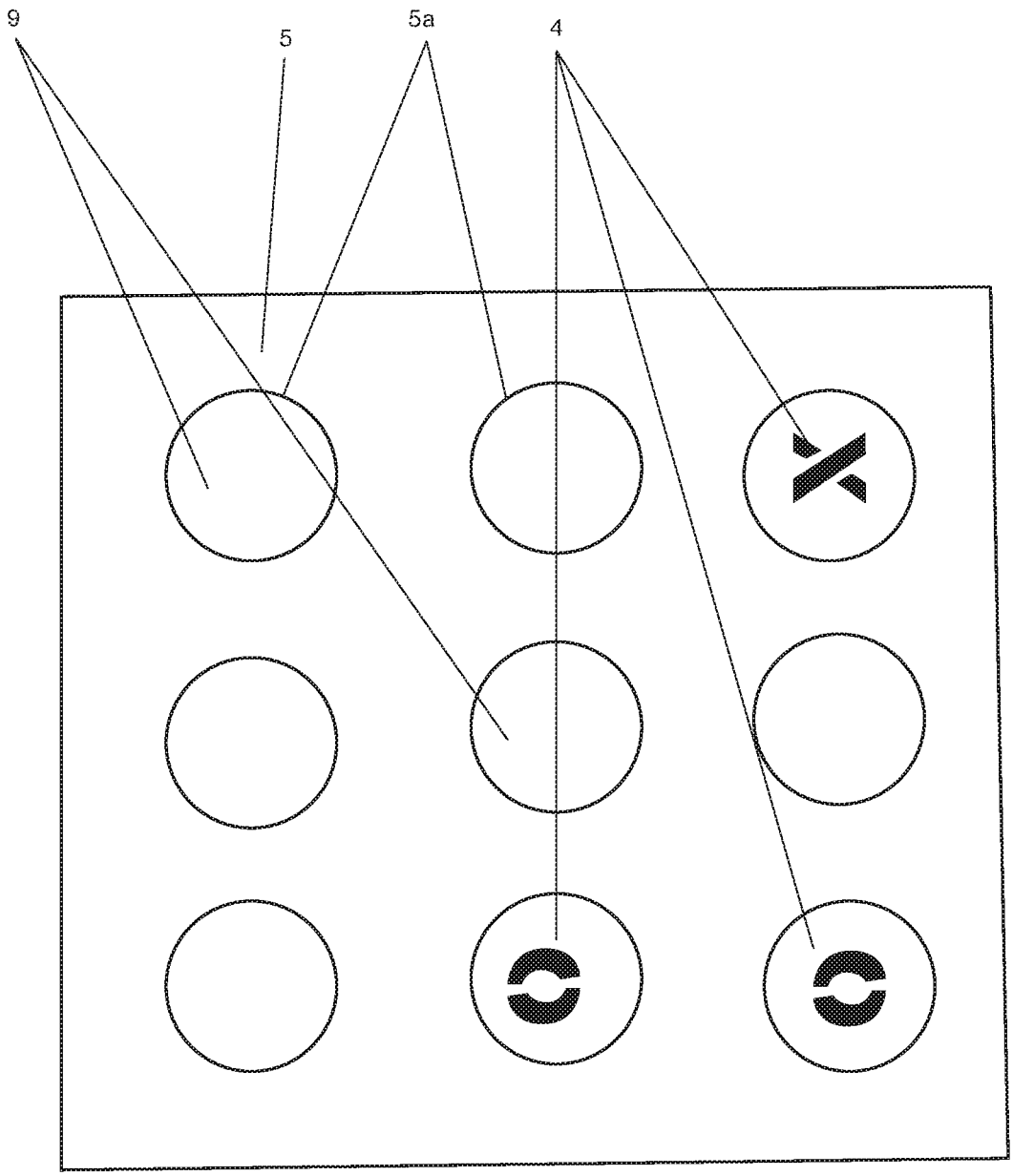
FIG. 8 shows an inverted game apparatus with a lid closed (not shown) and with the base in view; apertures in the base reveal 3 symbol playing pieces that have been previously inserted into the grid with the symbol side positioned against the base. Blank playing pieces occupy the other grid openings, as seen through the base aperture features; there is no successful placement of three symbol playing pieces in a row yet.

Longer Version:

In some embodiments, a longer version of the game uses a game assembly similar to the game assembly used in the above described simple version of the game except that in addition to using at least 10 symbol playing pieces, at least 9 multi-sided blank playing pieces are also used to fill all the 9 openings in the grid before play. FIG. 6 illustrates a game apparatus containing blank playing pieces 9 inserted into all grid openings at the start of play. Several symbol playing pieces 4 sit outside of the apparatus in the background, ready to be inserted into the grid openings when each player makes a move; a player moves by selecting a playing area and removing a blank playing piece from the selected playing area or grid opening to then insert a symbol playing piece into the grid opening with the symbol directed down towards the base (not shown). This version is more complex and presents more challenge. To play the game, blank playing pieces are first inserted into each opening in the grid and symbol playing pieces are divided between two players so that one player has at least 5 pieces, each with one symbol and the other player has an equal number of playing pieces each having a second symbol different than that one symbol. In other embodiments, 8 multi-sided blank playing pieces are included in the game assembly and, at the start of play, the player who goes first inserts the 8 blank playing pieces into the grid openings and leaves one grid opening vacant without a blank playing piece so that the player can then insert his or her symbol playing piece into that opening to make the first move. An example of this is shown in FIG. 7 where the game apparatus contains 8 blank playing pieces the player making the first move has created one playing area 3*a* to receive a symbol playing piece to be inserted with the symbol side down against the base. The embodiments where 8 blank playing pieces are used, instead of 9, may be desired when an even number of total playing pieces (10 symbol playing pieces and 8 blank playing pieces) are desired for packaging the game assembly. Either way, to play the longer version of the game, each player takes a turn which includes the removal of a blank playing piece from the grid, followed by insertion of a symbol playing piece into the opening by positioning the symbol playing piece in the opening with the symbol facing down against the game apparatus base. FIG. 8 shows the base of an inverted game apparatus which reveals through apertures two "O" and one "X" symbol on symbol playing pieces 4 that have been previously inserted into the grid with the symbol side positioned against the base. Blank playing pieces 9 occupy the other grid openings, as seen through the base aperture features 5*a*; there is no successful placement of three symbol playing pieces in a row yet as an additional blank playing piece previously removed from the grid sits in the background.

In the longer version of the game, each player takes turns after the initial first move, removing a blank playing piece to create an opening and inserting a symbol playing piece into the opening. If a player mistakenly attempts to remove a blank playing piece and instead removes any symbol playing piece, that player loses. The game is played until a player attempts to remove a blank piece from the grid and instead incorrectly removes any symbol playing piece; or a player announces a successful placement of three symbol playing pieces in a row, as determined by observing the base; or a player incorrectly announces placement of three symbol playing pieces in a row, as determined by observing the base; or all symbol playing pieces are inserted into all grid openings and no successful placement of playing pieces is announced, with the game ending in a draw. Optionally, and in the event that the game ends in a draw, players may continue to play by alternatingly removing their respective symbol playing pieces until one player incorrectly removes the wrong symbol playing piece. In this longer version of the game, the initial step of alternatingly removing blank playing pieces before each play creates extra challenge. When all symbol playing pieces are inserted except one, then the next player to take a turn must remove from the grid the last blank playing piece, before inserting his or her symbol playing piece into the grid and if he or she doesn't pick up the last remaining blank playing piece, and instead picks up any symbol playing piece, then that player loses. In this longer version, this initial step of having players remove blank playing pieces from the grid before placement of a symbol playing piece, combined with the option of, after a draw, each player alternatingly removing their respective symbol playing pieces from the apparatus, provides greater challenge, requires more memorization and significantly reduces the likelihood of the game ending in a draw.

To end in a draw playing any of the game versions described herein, each player must remember all prior moves accurately and strategize to block the other player from forming tic-tac-toe while trying to obtain tic-tac-toe himself.

There are additional alternative methods of ending the longer version of the game. Optionally, when a player has mistakenly removed the wrong playing piece, e.g., removal of a symbol playing piece instead of a blank playing piece, the players can further require that the last player return the playing piece he or she had mistakenly taken (either X or Y) back into to the apparatus grid, and the opposing player can have an opportunity to win the game at this point, by making a successful next move, for example, correctly identifying and removing the last remaining blank playing piece or a blank playing piece if there is more than one left. If neither person can do this the game ends in a draw.

There are yet further various optional ways to end any versions of the game and reduce the probability of a draw. For example, in playing the simple or longer version of the game, once all the grid openings are filled with symbol playing pieces, and neither player has declared himself a winner, each player may continue to alternatingly takes turns pulling out his or her symbol playing pieces one by one. First player to choose an incorrect symbol playing piece, or the other player's symbol playing piece, loses. This game ends in a draw if both players pull out all of their symbol playing pieces correctly.

With respect to playing any versions of the games described herein, players have multiple goals. For example, the goal of winning, not losing and remembering where every piece has been placed. In regular tic tac toe the player always knows exactly where to put the last X or O and thus the game often ends in a draw, which sometimes is obvious several moves before the game is even over. In the games of the subject invention, no one may know who is going to win until the very last move, as a player can easily forget where that last blank playing piece is lying.

The tic-tac-toe games and methods contemplated herein may alternatively be embodied as a computer program product. In an alternate version of the game, each players' moves are tracked electronically and determination of whether a player wins may also be done electronically. In some embodiments, the players can view the grid as displayed on one or more viewing surfaces and once a space or playing area is selected to be occupied by a symbol, that player's symbol is then concealed from the players and the playing area is displayed to appear identical to the previously selected areas, i.e., they are indistinguishable. The computer does the job of "remembering" where symbol playing pieces, for example each X and each 0, have been placed on the grid, and the moves can be revealed by input from a player, for example, a touch of a button, when either player declares victory or when the game ends in a draw.

The game apparatus of the instant invention can be embodied in a computer program product. Such a computer program product as taught herein is stored on a computer readable medium, such as a hard disk, an optical disk (e.g., CD-ROM or DVD disk), flash memory stick or the like.

Figure 9:
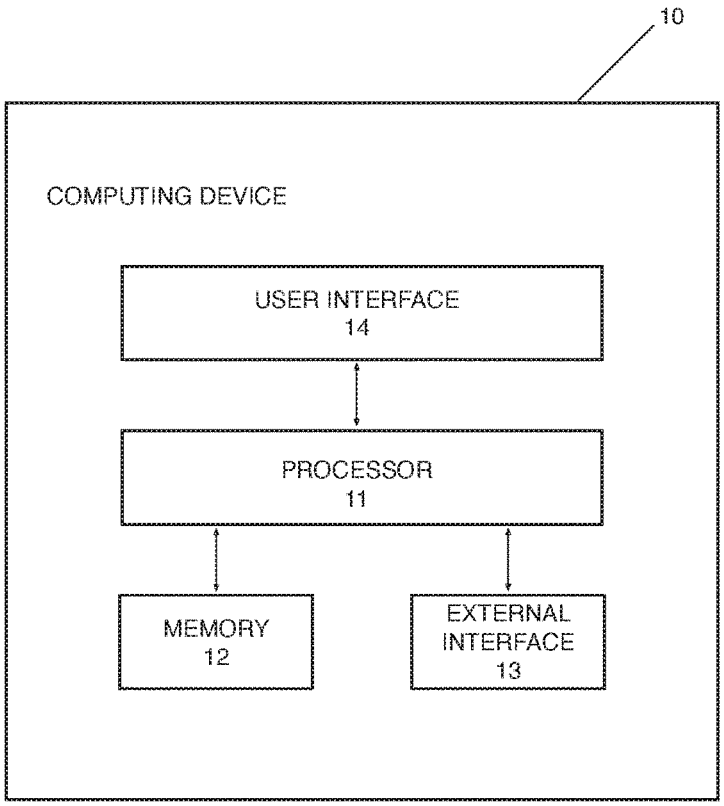
FIG. 9 is a block diagram of a computing device configured to execute computer program code of a computer program product, according to one or more embodiments.

So stored, the computer program product includes computer program code that may be executed by a processor associated with a computing device. FIG. 9 illustrates one embodiment of such a computing device, which may be a desktop computer, a laptop computer, a mobile phone, tablet, a portable digital assistant, or the like.

In FIG. 9, a computing device 10 includes a processor 11, memory 12 and/or external interface 13, and a user interface 14. The computer program product may be stored on memory 12 or some other medium readable by the processor 11 via external interface 13. When the computer program code is accessed and executed by the processor 11, the code causes the device 10 to implement the tic-tac-toe related games between at least two players as described by the methods herein. One of the players may be a remote player that plays against the user of the device 10 via a remote communication s interface (not shown).

In another embodiment, one of the players is a computerized opponent configured to play against the user of the device 10, in accordance with the computer program code. For example, after each move by the user, the computerized opponent can consider numerous variables such as: the user's last move or moves, opportunities to block the user from forming tic-tac-toes, or placement of three of the user's symbols in a row, opportunities for the computerized opponent to form tic-tac-toes, time into the game (beginning stages, intermediate stages, final stages) and potential future opportunities of the user and the computer for forming tic-tac-toes. The computing device or program code may cause the device to analyze these variables with the aid of accessing the memory of the user's moves and prior moves. In this regard, the code may cause the device 10 to analyze all or a portion of these variables to make an intelligent move, in the context of a selected difficulty level. Regardless, the code causes the device to perform the processing illustrated in FIG. 10.

Figure 10:
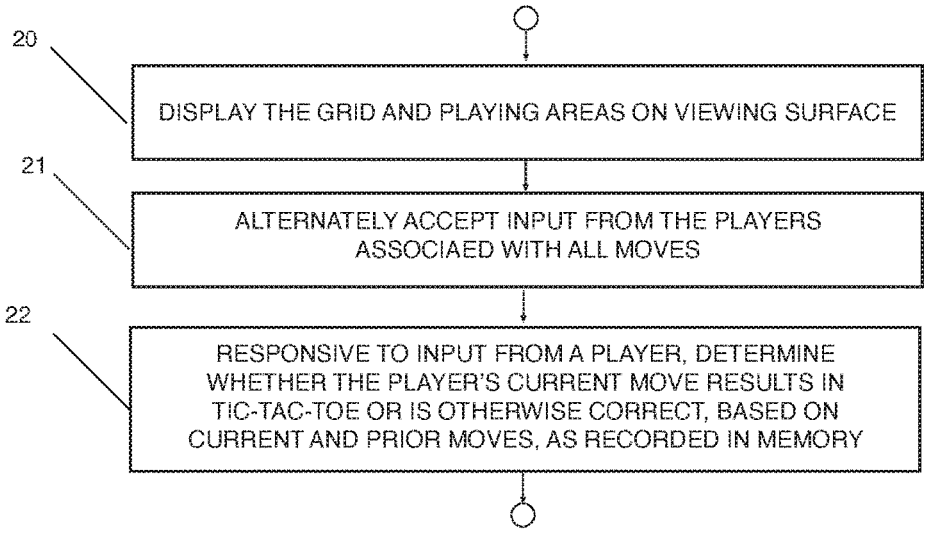
FIG. 10 is a logic flow diagram of processing performed in accordance with the computer program product of FIG. 9.

As shown in FIG. 10, the code causes the device 10 to display a three by three matrix grid comprised of 9 openings or playing areas on a viewing surface associated with the user interface 14 (block 20). All playing areas are identical in appearance, size and shape and at the start appear indistinguishable. In some embodiments, for example, grid openings or playing areas are square. Other shapes may be used.

The code also causes the device 10 to accept input from each of the players associated with each of the moves (block 21). The code may cause the device 10 to accept this input from user interface 14, or from a remote communications interface (not shown). If one of the players is a computerized opponent, the code may cause the device 10 to accept input associated with a players' moves of that computerized opponent in accordance with a selected difficulty level. Regardless, the input associated with a player's moves includes any moves described herein, for example, the selection of one of the playing areas or grid openings to insert a symbol or symbol playing piece as discussed herein or a selection of one of the playing areas or grid openings to first remove a blank playing piece in accordance with embodiments using the longer version of the game, or, in the event a game ends in a tie and players wish to continue playing, a player's move may involve the selection of a players own symbol playing piece to remove that symbol playing piece from the grid.

For any of a player's moves as described herein, the code causes the device 10 to, responsive to input from a player, render a determination as to whether the player's move is correct or not based on all previous moves as recorded in memory, for example memory 12. A determination may be made as to whether a player's announcement of forming tic-tac-toe or the like is correct or not. In some embodiments, a determination may be made as to whether a player's selection of a playing area to insert a symbol is available and not previously selected by any player, in other words, in playing the longer version of the game, whether a player has correctly selected a blank playing area that has not had a symbol previously placed therein, to execute his move. In some embodiments where the game has appeared to end in a draw and all grid openings contain symbols (not visible from the display on the viewing surface) and players wish to continue play by removing their own symbol playing pieces from the grid, the code causes the device to, responsive to input from a player on a move, render a determination as to whether a player correctly selected his own symbol playing piece to remove from the grid or mistakenly removed the other player's symbol.

In some embodiments the code causes the device to award points to respective players for tic-tac-toes formed and subtract points for incorrect moves described herein and incorrect announcements of tic-tac-toes, providing cumulative total points per player. The code then causes the device to determine the winner of the game as the player with the most total points. Points may be accumulated for each player over one or more games. In embodiments where more than one game is to be played, code causes the device to display the current game score (in terms of points), past game results (in terms of how many previous games each player won), the number of remaining moves until the winner is declared, and which player has a current turn. Additional processing implemented by some embodiments of the computer program code may be included in electronic embodiments. For example, initialization options for the game may include display menu and/or settings on the viewing screen that enable input for having two players play the game, one player play the game with the device as the second player, choosing the level of difficulty such as the simple or long version of the game described herein, choosing which player moves first, then alternating moves among players and an option for sound on/off and resetting the score to 0-0. Settings can configure the number of players and which player has the first move. In the case where there is one player playing against the device, the settings also configure the level of difficulty e.g, (beginner, intermediate, advanced) wherein the more challenging levels include practice of the longer versions of the method of play described herein. Once play is started, the computer program code causes the device to display the 3 columns by 3 rows grid on a viewing screen suitable for the device. The code causes the device to accept input from each player associated with a move. The player may, for example, select a playing area via the user interface which may comprise a touchscreen interface. The code causes the device to record each and all types of players' moves described herein. The code also causes the device to, responsive to input from each player in connection with a move or in connection with announcing a tic-tac-toe, render a determination as to whether a player has correctly selected three playing areas in a row, based on any of said player's previous moves as recorded in the memory. In some embodiments where the longer version of the game is played, the code also causes the device to render a determination as to whether a player's selection of one of said playing areas was correctly made or incorrectly a selection of a previously selected playing area by any player.

While the invention has been described as embodied, it is not intended to be limited to the details shown, since it will be understood that various omissions, modifications, substitutions and changes in the forms and details of the assembly and methods illustrated and in its operation can be made by those skilled in the art without departing in any way from the spirit of the invention.

Example

In one embodiment, a game assembly comprises cube shaped playing pieces that consist of 10 blocks, 5 blocks marked with an X on one side only and five blocks marked with an O on one side only, all other sides being blank. The symbols are positioned in the center of the one side of each symbol playing piece. The game assembly also includes an apparatus having disposed therein a housing that defines an interior cavity. The housing walls are all ¼ inch wide. Disposed within the interior cavity of the housing is a grid of four horizontal grid walls and 2 vertical grid walls providing 3 horizontal rows by 3 vertical columns that provide 9 grid openings or playing areas. The openings are substantially identical in size and configured to receive the cube or block playing pieces. The playing pieces are substantially identical in size, each 1½ inches wide by 1½ inches long by 1½ inches deep. Each opening or cubicle in the grid is designed and sized to receive the playing pieces. The height of the grid walls disposed within the interior cavity of the housing are shorter and lower than the housing walls, 1¼ inches in height. The width of the grid walls are variable. The width of the two horizontal grid walls that are adjacent to the housing are ⅛ inch and the other two horizontal grid walls disposed within the cavity are ¼ inch. The width of the vertical grid walls are ⅛ inch. The exterior of the housing measures 6 inches by 5.5 inches, leaving about a ¼ inch for spacing in the grid. The grid rests on a base or underside of the apparatus. The housing has a top side and bottom side and the base is connected to the bottom side of the housing. The base is flat and holds the playing pieces in place within the grid, once they are inserted into the grid. The base is made of wood material. The base contains 9 identically sized apertures or holes positioned in the center of each grid opening. The apertures are sized to reveal the symbols on the symbol playing pieces when the symbol playing pieces are inserted into the grid openings with the symbol facing down against the base. The diameter of each of the apertures are 1 inch and the symbols are ¼ inch. The dimensions of the base align with the housing. The width of the base is ⅛ inch. In embodiments where apertures are included in the base, a base with a shorter width may be selected to allow for optimal visibility of symbols on the playing pieces.

A lid is connected to the top portion of the housing along one side. Connection of the lid to the housing may be by any suitable means. In this example, a metal hinge is used. The lid is also made of wood material and sized to cover the square area of the grid and width of housing edges. The lid opens by folding over one side of the housing and can also close to cover the grid. When the lid is open, playing pieces may be inserted into the grid openings. When the lid is closed, playing pieces that have been inserted into the grid openings are removably secured within the openings and symbol paying pieces that have been placed into the grid with the symbol side down may be observed from the base when the apparatus is inverted or flipped over with the base in view. The apparatus housing, base and grid are also made of wood material so that the entire game assembly, except for the hinge and other connection materials, are wood.

The game assembly additionally comprises 8 extra blocks that are each blank on all sides (blank playing pieces). With the exception of having no X's and O's, these blank blocks are identical in size and appearance to the set of 10 symbol playing pieces described above. There is a total of 18 playing pieces. When the game assembly is packaged, nine of the 18 playing pieces are stored inside the housing, with the remaining 9 playing pieces positioned underneath the base or above the lid.

To play the game, 8 blank blocks are placed in the grid openings, filling the grid with blank blocks before play begins. The player that goes first decides where to first move by deciding which grid opening will not contain a blank block to start; then he or she places his or her symbol playing piece into the grid opening as the first opening move. As each player then moves to play the game, a blank block is removed by each player respectively prior to a symbol playing pieces being inserted. In playing the game, each player inserts his or her symbol playing pieces into the grid by positioning the symbol playing piece with the symbol side down against the base. The game is played until one of the following occurs: a player attempts to remove a blank piece from the grid and instead incorrectly removes any symbol playing piece; or a player announces placement of three symbol playing pieces in a row, which is deemed correct as determined by observing the base; or a player incorrectly announces placement of three symbol playing pieces in a row, as determined by observing the base; or 9 symbol playing pieces are inserted into the grid with no player announcing placement of his or her respective symbol playing pieces in a row. In the longer version of the game the players alternatingly remove their own blocks from the grid, until either player chooses another player's block and loses or until all the blocks are removed, thus ending in a draw.

What is claimed:

1. A game assembly for playing tic-tac-toe comprising:

a plurality of playing pieces each having multiple sides, the plurality of playing pieces comprising:

a) at least 10 symbol playing pieces, each symbol playing piece having a symbol disposed on one side and a blank on all other sides, wherein half of the pieces each have a first symbol disposed on one side, and an other half of the pieces each have a second symbol disposed on one side, wherein the first symbol is different from the second symbol; and b) at least 8 blank playing pieces that are blank on all sides; and an apparatus comprising:

a) a housing defining an interior cavity;

b) a grid disposed within the housing, the grid defining a three row by three column matrix of 9 openings, each opening of the 9 openings configured to receive any one of the plurality of playing pieces through a first side of the grid and separated from an adjacent opening by a spacer; and c) a base coupled directly to the grid, the base comprising one of transparent or aperture features configured to display the symbol of each symbol playing piece when each symbol playing piece is inserted into the grid with the symbol facing the base;

wherein the at least 8 blank playing pieces are configured to be inserted into the grid; and wherein at least a portion of the at least 8 blank playing pieces are configured to be replaced by a portion of the at least 10 symbol playing pieces.

2. The assembly set forth in claim 1, wherein the apparatus is constructed to receive and secure the plurality of playing pieces such that the plurality of playing pieces remain within the grid when the apparatus is turned upside down.

3. The assembly set forth in claim 1, wherein at least one of the housing, grid or base comprises a fastening element configured to removably secure the plurality of playing pieces within the grid.

4. The assembly set forth in claim 3, wherein the fastening element comprises one of magnets or hook and loop fasteners.

5. The assembly set forth in claim 3, wherein the fastening element comprises a lid.

6. The assembly set forth in claim 5, wherein the lid is coupled to the housing through a hinge.

7. The assembly set forth in claim 1, wherein the first symbol comprises an "X" and the second symbol comprises an "O".

8. The assembly set forth in claim 1, wherein the plurality of playing pieces and apparatus comprise wooden material.

9. The assembly set forth in claim 1, wherein the plurality of playing pieces are cube shaped and each opening of the 9 openings is square.

10. The assembly set forth in claim 1, wherein the at least 8 blank playing pieces comprises 9 blank playing pieces.

11. A method of playing a game comprising:

a. providing a game assembly comprising 10 symbol playing pieces, at least 9 blank playing pieces, a housing, a grid disposed within the housing a defining a plurality of openings, and a base directly coupled to a second side of the grid, the base comprising one of transparent or aperture features;

b. inserting the 9 blank playing pieces into the plurality of openings within the grid through a first side of the grid opposite the second side of the grid;

c. dividing the 10 symbol playing pieces between two players so that a first player has 5 pieces comprising a first symbol and a second player has 5 pieces comprising a second symbol, wherein the first symbol is different from the second symbol;

d. alternatingly removing, by each player, one of the 9 blank playing pieces from the grid and replacing the one of the 9 blank playing pieces with one of the 10 symbol playing pieces by positioning the one of the 10 symbol playing pieces with one of the first symbol or second symbol facing the base; and e. playing the game until one of the following occurs: i) a player attempts to remove one of the 9 blank playing pieces from the grid but instead removes one of the 10 symbol playing pieces; ii) a player correctly announces a placement of one of three of the 5 pieces comprising the first symbol in a row or three of the 5 pieces comprising the second symbol in a row, as determined by observing the base; iii) a player incorrectly announces placement of one of three of the 5 pieces comprising the first symbol in a row or three of the 5 pieces comprising the second symbol in a row, as determined by observing the base; iv) 9 symbol playing pieces of the 10 symbol playing pieces are inserted into the grid with no player announcing placement of one of three of the 5 pieces comprising the first symbol in a row or three of the 5 pieces comprising the second symbol in a row.

12. A method of playing a game as set forth in claim 11, wherein prior to observing the base the housing is turned upside down.

13. A game assembly for playing tic-tac-toe comprising:

a plurality of playing pieces comprising:

e) at least 10 symbol playing pieces, each symbol playing piece having a symbol disposed on one side and a blank on all other sides, wherein half of the pieces each have a first symbol disposed on one side, and an other half of the pieces each have a second symbol disposed on one side, wherein the first symbol is different from the second symbol;

b) at least 9 blank playing pieces that are blank on all sides; and an apparatus comprising:

a) a housing comprising a top and bottom, the housing defining an interior cavity;

b) a grid disposed within the interior cavity, the grid defining a three row by three column matrix of 9 openings, each opening of the 9 openings configured to receive any one of the plurality of playing pieces through a first side of the grid and separated from an adjacent opening by a spacer;

c) a base connected to the bottom of the housing and facing a second side of the grid opposite the first side of the grid, the base comprising one of transparent or aperture features configured to display the symbol of each symbol playing piece when each symbol playing piece is inserted into the grid with the symbol facing; and d) a lid coupled to the top of the housing, the lid configured to open to receive the plurality of playing pieces and configured to close to secure the plurality of playing pieces such that the plurality of playing pieces remain within the grid when the apparatus is turned upside down;

wherein the at least 9 blank playing pieces are configured to be inserted into the grid; and wherein at least a portion of the at least 9 blank playing pieces are configured to be replaced by a portion of the at least 10 symbol playing pieces.

* * * * *